US008573001B2

(12) United States Patent
Koo

(10) Patent No.: US 8,573,001 B2
(45) Date of Patent: Nov. 5, 2013

(54) APPARATUS FOR OPERATING DISPENSER IN REFRIGERATOR

(75) Inventor: Min-Bon Koo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 713 days.

(21) Appl. No.: 12/677,666

(22) PCT Filed: Aug. 25, 2008

(86) PCT No.: PCT/KR2008/004955

§ 371 (c)(1),
(2), (4) Date: Mar. 11, 2010

(87) PCT Pub. No.: WO2009/051341

PCT Pub. Date: Apr. 23, 2009

(65) Prior Publication Data

US 2010/0199704 A1 Aug. 12, 2010

(30) Foreign Application Priority Data

Oct. 16, 2007 (KR) ..... 10-2007-0104180

(51) Int. Cl.

| | |
|---|---|
| ***H01H 3/20*** | (2006.01) |
| ***H01H 13/00*** | (2006.01) |
| ***B67D 7/80*** | (2010.01) |
| ***F25D 3/00*** | (2006.01) |

(52) U.S. Cl.
USPC ..... 62/389; 222/146.6; 200/332; 200/341

(58) Field of Classification Search
USPC ..... 62/389; 222/146.6, 509, 508, 517, 222/146.1, 146.2; 200/332, 341
See application file for complete search history.

(56) References Cited

U.S. PATENT DOCUMENTS

| | | | | |
|---|---|---|---|---|
| 3,341,065 | A * | 9/1967 | Schuldt et al. | 222/1 |
| 3,934,757 | A | 1/1976 | Malek et al. | |
| 5,819,913 | A * | 10/1998 | Reiter | 200/332 |
| 6,003,734 | A | 12/1999 | Oh | |

FOREIGN PATENT DOCUMENTS

| | | | |
|---|---|---|---|
| JP | 11-508028 | A | 7/1999 |
| KR | 10-2004-0042965 | A | 5/2004 |
| KR | 10-2007-0077918 | A | 7/2007 |
| KR | 10-0766119 | B1 | 10/2007 |

* cited by examiner

*Primary Examiner* — Cassey D Bauer
(74) *Attorney, Agent, or Firm* — Birch, Stewart, Kolasch & Birch, LLP

(57) ABSTRACT

Disclosed is an apparatus for operating dispenser in a refrigerator, comprising a base member having a switch by which a dispenser of a refrigerator is operated: a pushing member for transferring a pushing force to the switch; a plurality of connection units connecting the pushing member and the base member to each other so that the switch may be pushed even if any position of the pushing member is pushed. According to the dispenser operating apparatus for a refrigerator, since the pushing member for transferring the pushing force to the switch is respectively supported at right and left side ends of the upper portion and the lower portion thereof by the plurality of connection units, the pushing force can be transferred to the switch even if any position of the pushing member is pushed, which may be convenient to users.

4 Claims, 6 Drawing Sheets

APPARATUS FOR OPERATING DISPENSER IN REFRIGERATOR

TECHNICAL FIELD

The present invention relates to a refrigerator, and more particularly, to an apparatus for operating dispenser in a refrigerator having a dispenser operating unit by which a dispenser is operated wherever the dispenser operating unit is pushed.

BACKGROUND ART

Generally, a refrigerator, an appliance for storing food at a low temperature, stores foods in a freezing manner or a cooling manner depending upon foods to be stored.

Currently, the refrigerators have been large and multifunctional according to various demands of users and changes of dietary life of them. Such refrigerator generally has a dispenser for discharging out purified water or ice cubes without opening a door thereof.

The dispenser is generally formed at the door of the refrigerator and is manipulatable in various manners. An exemplary dispenser in the related art is shown in FIG. 1.

FIG. 1 is a side section view schematically showing an operation state of a dispenser for a refrigerator in the related art. Referring to FIG. 1, a dispenser 10 includes a dispenser casing 11 and a deco cover 12.

The dispenser casing 11 forms a shape of an inner side of the dispenser 10. The dispenser casing 11 is concaved toward the inside of the refrigerator door by a specific depth so that a space for receiving a cup (C) or a container similar to the cup for receiving water or ice cubes therein may be formed.

The deco cover 12 is disposed at a front side of the dispenser casing 11 so as to form an external appearance of the dispenser 10 by partially shielding a front surface of the dispenser casing 11.

The deco cover 12 is provided with an opening corresponding to the space of the dispenser casing 11. Through the opening, the cup (C) for discharging out water and ice cubes is taken in and out.

The dispenser casing 11 has an upper middle portion provided with a discharge outlet 13 for downwardly supplying purified water or ice cubes.

And, a manipulation lever 14 is formed at a middle portion of an inner side surface of the dispenser casing 11. The manipulation lever 14 serves to manipulate an operation of the dispenser 10 and is configured to determine whether the discharge outlet 13 is to be opened or closed depending on user's manipulation.

The manipulation lever 14 has an upper end coupled to one side of the dispenser casing 11 or the dispenser 10 by a hinge.

Thus, if the user pushes the manipulation lever 14 with using the cup (C), a lower portion of the manipulation lever 14 may be rotated in a clockwise direction by a specific angle. According to the rotation of the manipulation lever 14, a switch (not shown) that is separately provided is selectively operated. Hence, purified water and/or ice cubes are contained in the cup (C).

However, the related art has the following problems.

First, the upper end of the manipulation lever 14 is coupled to an upper end of the dispenser casing 11 or one side of an upper portion of the dispenser 10 by a hinge. Thus, if the upper end of the manipulation lever is pushed by the cup (C), the manipulation lever 14 may not be rotated. Accordingly, water or ice cubes may not be discharged out.

Second, a torsion spring is fitted at a hinge coupling shaft of the manipulation lever 14 so as to restore the manipulation lever 14 after completing discharging of water or ice cubes. However, the manipulation lever 14 may not be restricted to rotate in a counterclockwise direction after completion of the restoration, accordingly a position where the manipulation lever 14 is restored may not be constant.

DISCLOSURE OF THE INVENTION

Technical Problem

Therefore, it is an object of the present invention to provide an apparatus for operating dispenserin a refrigerator having a dispenser operating unit by which a dispenser is operated wherever the dispenser operating unit is pushed.

Technical Solution

To achieve the object, there is provided an apparatus for operating dispenser in a refrigerator, comprising: a base member having a switch by which a dispenser of a refrigerator is operated; a pushing member for transferring a pushing force to the switch; and a plurality of connection units connecting the pushing member and the base member to each other so that the switch may be pushed even if any position of the pushing member is pushed.

The plurality of connection units are respectively provided at right and left side ends of an upper portion and a lower portion of the pushing member.

Each connection unit comprises a coupling protrusion protruded from a rear surface of the pushing member; a coupling hole formed at the base member to correspond to the coupling protrusion; and an elastic member fitted into the coupling protrusion.

The coupling protrusion is provided with a guide groove in a length direction thereof. And, a guide protrusion is provided at one side of the base member so as to guide motions of the pushing member along the guide groove.

The base member has one side provided with a supporting protrusion facing the guide protrusion to each other and supporting the coupling protrusion fitted into the guide protrusion not to be separated therefrom.

The pushing member is provided with a pushing protrusion at a middle portion of one of both side ends thereof so as to transfer the pushing force to the switch.

A transfer member is provided between the pushing protrusion and the switch so as to amplify displacement of the pushing protrusion and then transfer it to the switch.

Advantageous Effects

The dispenser operating apparatus for a refrigerator according to the present invention has the following advantages.

First, since the pushing member for transferring the pushing force to the switch is respectively supported at right and left side ends of the upper portion and the lower portion thereof by the plurality of connection units, the pushing force can be transferred to the switch even if any position of the pushing member is pushed, which may be convenient to users.

Second, since the guide groove is provided at the coupling protrusion so as to guide motions of the pushing member along the guide protrusion formed at one side of the base member and the supporting protrusion is provided so as to prevent the coupling protrusion from being separated, it is capable of constantly maintaining a restoration position of the pushing member and of stably performing the restoration operation.

MODES FOR CARRYING OUT THE PREFERRED EMBODIMENTS

Description will now be given in detail of an apparatus for operating dispenser in a refrigerator in accordance with a first embodiment of the present invention, examples of which are illustrated in the accompanying drawings.

Figure 1:
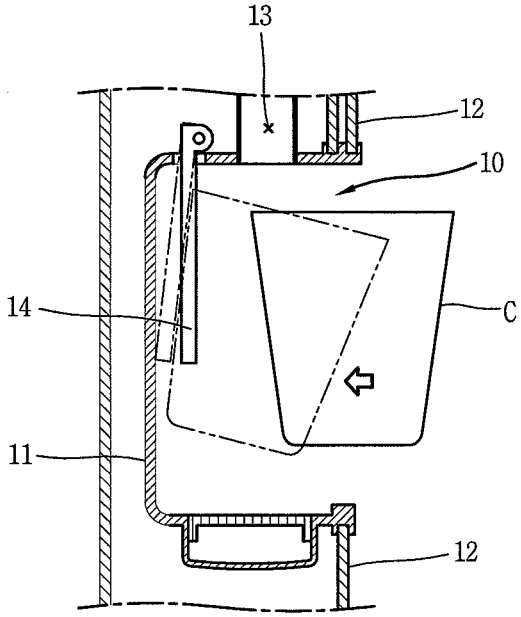
FIG. 1 RELATED ART
FIG. 1 is a side section view schematically showing an operation state of a dispenser for a refrigerator in the related art.
Figure 2:
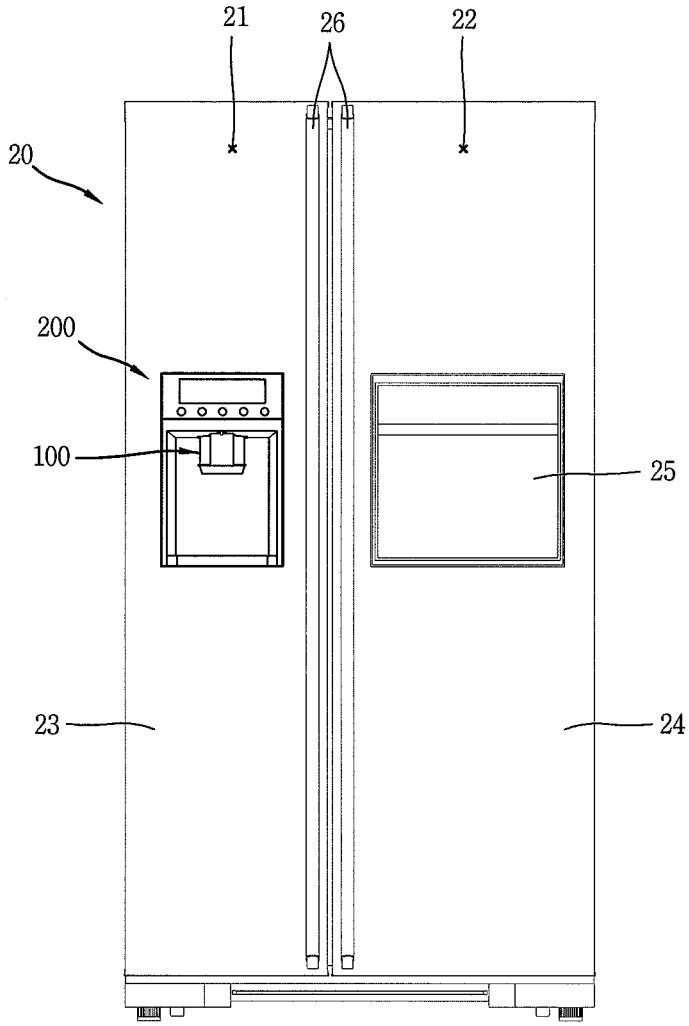
FIG. 2 is a front view showing an external appearance of a refrigerator to which an apparatus for operating dispenser in a refrigerator in accordance with a first embodiment of the present invention is applied.

FIG. 2 is a front view showing an external appearance of a refrigerator to which an apparatus for operating dispenser in a refrigerator in accordance with a first embodiment of the present invention is applied.

As shown in FIG. 2, a main body 20 forming the external appearance of the refrigerator is approximately formed in a rectangular parallelepiped shape. A cooling chamber 22 and a freezing chamber 21, storage spaces for storing foods therein respectively in a chilling manner and a freezing manner, are respectively formed in the main body 20. Each front surface of the freezing chamber 21 and the cooling chamber 22 is configured to be open.

And, refrigerator doors 23, 24 are respectively provided at the opened front surfaces of the freezing chamber 21 and the cooling chamber 22. The refrigerator doors 23, 24 serve to selectively shield the opened front surfaces of the freezing chamber 21 and the cooling chamber 22 and are composed of the freezing chamber door 23 and the cooling chamber door 24. The refrigerator doors 23, 24 are respectively coupled to both sides of a front end portion of the main body 20 by hinges so as to be rotatable thereat.

Meanwhile, door handles 26 are provided at the front surfaces of the freezing chamber door 23 and the cooling chamber door 24. The door handles 26 are grasped by a user so that the refrigerator doors 23, 24 can be easily rotated. The door handles 26 are approximately formed in a cylindrical bar shape to be long in upper and lower directions.

And, a home bar 25 is provided at the cooling chamber door 24. The home bar 25 serves to discharge in or out water or a beverage, which is contained in a container and is frequently taken in/out without opening the cooling chamber door 24. The home bar 25 is formed at the front surface of the cooling chamber door 24.

The freezing chamber door 23 is provided with a dispenser 100. The dispenser 100 serves to easily discharge out purified water or ice cubes without opening the refrigerator doors 23, 24. The dispenser 100 is configured to be exposed toward the front surface of the freezing chamber door 23. Alternately, the dispenser 100 may be provided at the cooling chamber door 24.

Hereafter, a dispenser 200 will be explained in detail with reference to FIG. 3.

Figure 3:
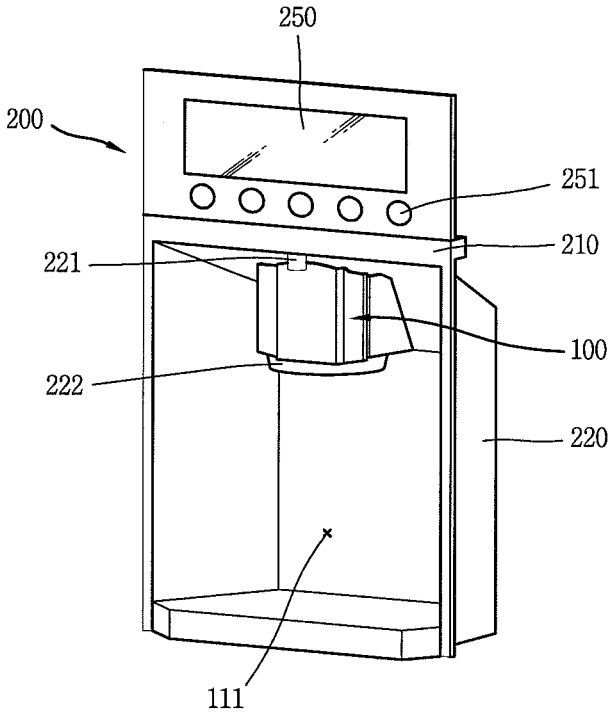
FIG. 3 is a view showing a configuration of a dispenser to which the dispenser operating apparatus for a refrigerator in accordance with the first embodiment of the present invention is applied.

FIG. 3 is a view showing a configuration of a dispenser to which the dispenser operating apparatus for a refrigerator in accordance with the first embodiment of the present invention is applied.

As shown in FIG. 3, the dispenser 200 includes a deco cover 210 and a dispenser casing 220.

The deco cover 210 serves to shield inner components of the dispenser 200 and to form an external appearance of the dispenser 200 exposed toward a front surface of the freezing chamber door 23. The deco cover 210 is coupled to a front end portion of the dispenser casing 220 to be explained below.

The deco cover 210 is provided with an opening 211. The opening 211 serves to expose out a concaved space of the dispenser casing 220 and is configured to be open approximately in a square shape.

And, the deco cover 210 has an upper portion, that is, an upper portion of the opening 211, provided with a display 250 displaying information about operations of the dispenser 200 including about overall operations of the refrigerator. The display 250 has a lower side provided with a plurality of manipulation buttons 251 for manipulating status of beverages and ice cubes discharged through the dispenser 100.

The dispenser casing 220 forming an inner shape of the dispenser 200 is concaved toward the inside of the freezing chamber door 23 by a specific depth. Also, the dispenser casing 220 is configured to be rounded by a specific curvature so as to obtain an excellent external appearance and convenience on use.

The dispenser casing 220 is separately provided with a water discharge outlet 221 and an ice cube discharge outlet 222. That is, the water discharge outlet 221 is provided at a middle portion of an upper end of the dispenser casing 220, and the dispenser operating apparatus 100 for operating the dispenser 200 is provided at a lower side thereof with being protruded from an inner wall of the dispenser casing 220. And, the ice cube discharge outlet 222 is formed through an inner space of the protruded dispenser operating apparatus 100.

Alternately, the water discharge outlet 221 may be formed at one side of the ice cube discharge outlet 222 through which ice cubes are discharged out.

In this case, the water discharge outlet 221 and the ice cube discharge outlet 222 are implemented in different sizes and shapes from each other. The water discharge outlet 221 and the ice cube discharge outlet 222 are configured to be downwardly open. And, the dispenser operating apparatus 100 may be located at the opened lower end portion of the ice cube discharge outlet 222 and the water discharge outlet 221 so that the user can manipulate it using a container such as a cup(C) and receive water or ice cubes, and may be provided at the inner side of the dispenser casing 220.

Hereafter, a configuration of the dispenser operating apparatus 100 for a refrigerator in accordance with the first embodiment of the present invention will be explained in detail with reference to FIGS. 4 to 6.

Figure 4:
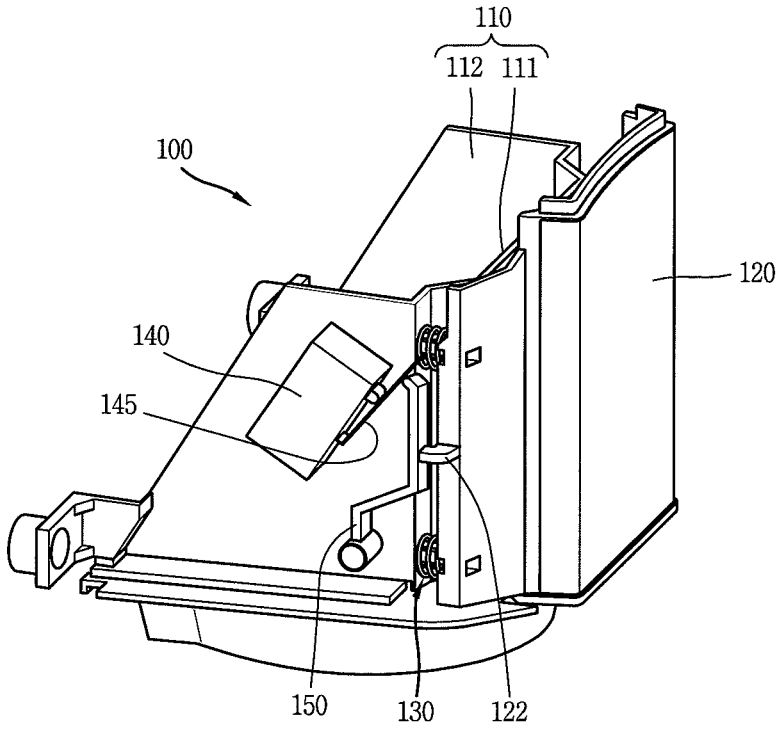
FIG. 4 is a view showing a configuration of the dispenser operating apparatus for a refrigerator in accordance with the first embodiment of the present invention.
Figure 5:
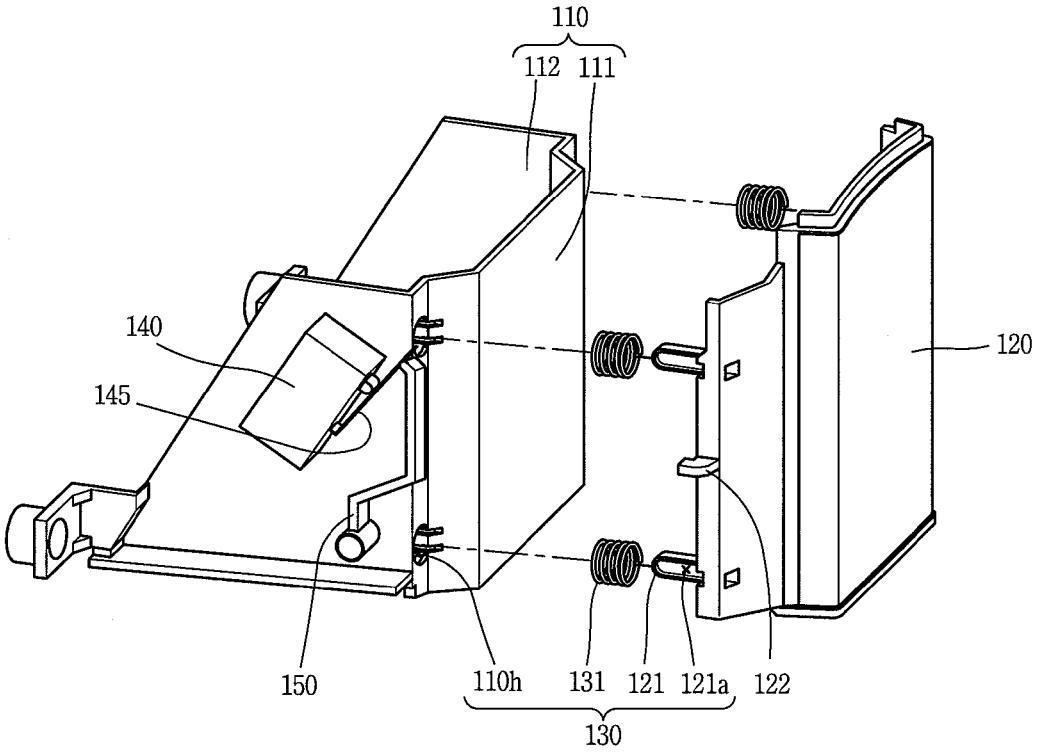
FIG. 5 is an exploded view showing the configuration of the dispenser operating apparatus for a refrigerator in accordance with the first embodiment of the present invention.
Figure 6:
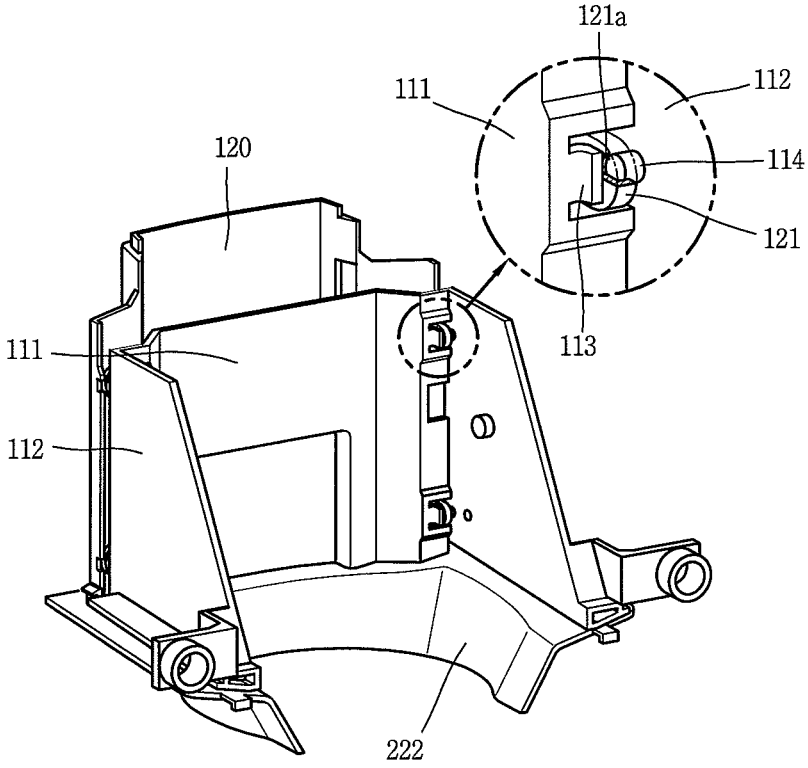
FIG. 6 is a perspective view showing a rear side of an apparatus for operating dispenser in a refrigerator according to the present invention.

FIG. 4 is a view showing a configuration of the dispenser operating apparatus in accordance with the first embodiment of the present invention, FIG. 5 is an exploded view showing the configuration of the dispenser operating apparatus in accordance with the first embodiment of the present invention, and FIG. 6 is a perspective view showing a rear side of a dispenser operating apparatus in accordance with the present invention.

As shown in FIGS. 4 to 6, the dispenser operating apparatus 100 for a refrigerator includes a base member 110 provided with a switch 140 by which the dispenser 200 is operated, a pushing member 120 for transferring a pushing force to a button member 145 of the switch 140, and a plurality of connection units 130 connecting the pushing member 120 and the base member 110 to each other so that the button member 145 of the switch 140 can be pushed wherever the pushing member 120 is pushed.

Here, the base member 110 consists of a front surface member 111 implemented as a rectangular shaped planar plate and side surface members 112 extended from both side ends of the front surface member 111 in a vertical direction. That is, the base member 110 is implemented by bending the rectangular shaped planar plate member in a "ㄷ" shape.

Coupling holes 110*h* are formed at the front surface member 111 so as for the pushing member 120 to be explained to be coupled thereto. The coupling holes 110*h* are formed at right and left sides of an upper side and a lower side of the front surface member 111, preferably.

The switch 140 by which the dispenser 200 is operated is fixed at the side surface member 112. And, a transfer member 150 may be fixed thereat so as to amplify displacement of the pushing member 120 and then transfer it to the button member 145 of the switch 140.

And, the ice cube discharge outlet 222 is received in a space formed by the front surface member 111 and the side surface members 112.

Meanwhile, the pushing member 120 is implemented as a rectangular shaped planar plate member to correspond to the front surface member 111 of the base member 110. And, the pushing member 120 is coupled to the base member 110 with having a specific gap therebetween by coupling protrusions 121 respectively formed at right and left ends of an upper portion and a lower portion of the pushing member 120.

The specific gap provides a space allowing the pushing member 120 to be pushed and moved.

The coupling protrusions 121 are protruded from the rear surface of the pushing member 120. And, guide grooves 121*a* are formed in a length direction of the coupling protrusions 121. Further, guide protrusions 114 are provided at one side of the base member 110 so as to guide motions of the pushing member 120 by being fitted into the guide grooves 121*a*.

The guide protrusions 114 are formed at the side surface member 112 of the base member 110 or are protruded from each inner circumferential surface of the coupling holes 110*h*, preferably.

The pushing member 120 is controlled to move in a direction facing the base member 110, that is, in right and left directions in FIGS. 4 and 5, caused by coupling of the guide grooves 121*a* and the guide protrusions 114, accordingly it is capable of enhancing reliability of operations of the dispenser 200.

Furthermore, supporting protrusions 113 may be formed to be protruded toward a rear side of the base member 110 from one side of the base member 110, that is, the inner circumferential surfaces of the coupling holes 110*h*, and to face the guide protrusions 114 to each other.

The supporting protrusions 113 serve to support the coupling protrusions 121 fitted into the guide protrusions 114 not to be separated therefrom. Preferably, the supporting protrusions 113 are provided to have an elastic force in a vertical direction with respect to the protruded direction.

Preferably, the pushing member 120 is provided with a pushing protrusion 122 at a middle portion of one of both side ends thereof so as to transfer a pushing force to the switch 140.

Since the pushing protrusion 122 is provided at the middle portion of the both side ends of the pushing member 120, the switch 140 can receive the pushing force by the pushing protrusions 122 even if the pushing member 120 is pushed at an abnormal position such as an upper side end or a lower side end thereof. In case that the pushing protrusion 122 is provided not at the middle portion of the both side ends of the pushing member 120 but at the upper side or the lower side thereof, any one side of the upper side end or the lower side end of the pushing member 120 may not transfer the pushing force to the switch 140.

Meanwhile, each of the connection units 130 includes the coupling protrusions 121 protruded from the rear surface of the pushing member 120, the coupling hole 110*h* formed at the base member 110 to correspond to the coupling protrusion 121 and an elastic member 131 fitted into the coupling protrusion 121 so as to elastically support the pushing member 120 under a state that the coupling protrusion 121 is coupled to the coupling hole 110*h*.

The elastic member 131 is generally implemented as a compressed spring. However, the elastic member 131 can be formed of any material having an elastic force such as rubber.

The transfer member 150 may be provided between the pushing protrusion 122 and the switch 140 with coming in contact with the pushing protrusion 122 and the switch 140.

The transfer member 150 is implemented as a bar shaped member and has one end fixed at the side surface member 112 of the base member 110.

The transfer member 150 is configured to have a middle portion receiving the pushing force by coming in contact with the pushing member 122 and the other end portion which is not fixed and serves to transfer the pushing force by coming in contact with the switch 140.

Accordingly, the displacement of the pushing protrusion 122 is amplified and then transferred to the switch 140. That is, when the transfer member 150 receives the pushing force by the pushing protrusion 122 and then is rotated by a specific angle, the displacement may increase because the other end of the transfer member 150 has a relatively large rotation radius.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. An apparatus for operating a dispenser in a refrigerator, comprising:

a base member having a switch by which a dispenser of a refrigerator is operated;

a pushing member for transferring a pushing force to the switch; and a plurality of connection units connecting the pushing member and the base member to each other, each of the connection units including:

a coupling protrusion protruded from a rear surface of the pushing member;

a coupling hole formed at the base member to correspond to the coupling protrusion; and an elastic member fitted onto the coupling protrusion, wherein the coupling protrusion is provided with a groove in a length direction of the coupling protrusion, wherein a guide protrusion is provided at one side of the base member so as to guide movement of the pushing member along the groove, wherein the base member has a supporting protrusion provided at one side of the base member, the supporting protrusion facing the guide protrusion and supporting the coupling protrusion to prevent the coupling protrusion from being separated from the guide protrusion, the coupling protrusion being fitted into the guide protrusion, and wherein the pushing member is provided with a pushing protrusion at a middle portion of one of both side ends of the pushing member so as to transfer the pushing force to the switch.

2. The apparatus of claim 1, wherein the plurality of connection units are provided at right and left side ends of an upper portion and a lower portion of the pushing member.

3. The apparatus of claim 1, wherein a transfer member has a first end rotatably coupled to the base member and a second end provided between the pushing member and the switch, the transfer member being configured to amplify the displacement of the pushing protrusion to cause the transfer member to come into contact with the switch while being rotated about the first end due to displacement of the pushing member.

4. The apparatus of claim 1, wherein the supporting protrusion protrudes toward the guide protrusion and is bent toward the rear surface of the base member so as to elastically support a side surface of the coupling protrusion.

* * * * *